United States Patent [19]

Regenbrecht

[11] 4,012,977

[45] Mar. 22, 1977

[54] APPARATUS FOR CONTROLLING MOVEMENT OF STAMPING DEVICE

[75] Inventor: Ludwig Regenbrecht, Gevelsberg, Germany

[73] Assignee: Rolf Peddinghaus, Gevelsburg, Germany

[22] Filed: Mar. 12, 1976

[21] Appl. No.: 666,210

[30] Foreign Application Priority Data

Mar. 13, 1975 Germany ..... 2511012

[52] U.S. Cl. ..... 83/368; 83/557

[51] Int. Cl.[2] ..... B26D 5/12

[58] Field of Search ..... 83/368, 557, 558

[56] References Cited

UNITED STATES PATENTS

| | | | |
|---|---|---|---|
| 3,785,235 | 1/1974 | Peddinghaus et al. | 83/557 |
| 3,803,961 | 4/1974 | Valente | 83/368 |
| 3,815,456 | 6/1974 | Braathen et al. | 83/558 |

*Primary Examiner*—Donald R. Schran
*Attorney, Agent, or Firm*—Dressler, Goldsmith, Clement, Gordon & Shore, Ltd.

[57] ABSTRACT

The apparatus for punching holes in a work member includes a weight-balanced frame member having supported thereon opposed punching die and a matrix. The frame is initially moved vertically to properly position the matrix and die relative to the member to be punched. Located adjacent the matrix are sensing elements that are positioned to be contacted by the member to be punched, which sensing elements, when contacted stop the vertical movement of the frame. This arrangement substantially reduces the pivotal movement of the frame member which occurs during the punching operation and thus greatly minimizes the movement of the balancing weight that is mounted on a lever to maintain the frame in the balanced position free of contact with the member to be punched and thus avoids any substantial acceleration of the weight member which could adversely affect the punching operation.

4 Claims, 5 Drawing Figures

HK
D
- 8 -

APPARATUS FOR CONTROLLING MOVEMENT OF STAMPING DEVICE

The invention relates to a punching installation with a vertically guided frame bearing the matrix or anvil and carrying the punching die in vertically opposed relation. The punching die is actuated to operate upon the material to be punched after the matrix has been positioned into contact with the material to be punched. The frame is balanced by at least one reset spring and a balancing weight attached at the frame for returning the frame to a preset position. The balancing weight is longitudinally displaceable on a scale beam, with the guided frame engaging the shorter free end of the scale beam section while a reset spring connected to the frame attaches to the longer scale section. The scale beam is positioned pivotably at the upper end of a vertically adjustable piston rod.

In smaller and lighter punching installations of this kind the displacement path of the frame is of minor importance, although the weight arranged at the longer beam section has to travel a path larger by a multiple than does the punching frame. In punching installations of the kind dealt with herein where the frame and corresponding therewith the weight arranged at the longer scale beam section are large, the path traveled by the weight is of importance.

Further details of this type of device which are not important to an understanding of the present invention, but which can be referred to are found in U.S. Pat. No. 3,785,235 to Werner Peddinghaus and Ludwig Regenbrecht and patent application Ser. No. 498,915, filed Aug. 20, 1974 to Werner Peddinghaus and Ludwig Regenbrecht.

If, for example, the distance of the matrix from the bottom side of the material to be punched is 8 mm. and if the relation of the length of the shorter scale beam section to the distance of the weight from the pivoting point of the scale beam is 1:10, the weight must travel a path 10 times longer than that of the matrix, namely, 80 mm. In that case, the mass of the larger weight undergoes such an acceleration that the manner of operation of the punch is adversely affected, or additional means increasing the price of the installation are necessary in order to bring the mass of the weight to a stop within a short time, so that the punching operation can be performed.

A reduction of the distance between the matrix in its starting position and the bottom side of the material to be punched is prohibitive, because it must be taken into consideration that the material to be punched shows manufacturing tolerances which required a certain distance between the matrix and the material to be punched.

Consequently, the invention is based on the problem of so improving the punching installation described according to the above referred to principal patent that with the application of a heavy frame and a correspondingly heavy weight at the longer scale beam section there will not occur an excessive acceleration of the mass of this weight, so that no effect adversely affecting the punching operation is to be feared, and/or no additional expensive means will be required in order to bring the mass of the large weight quickly to a stop for a rapid operation with the punching operation.

For the solution of this problem, the invention contemplates in a punching operation according to the principal patent that the frame carries adjacent to the matrix at least one sensor protruding in the starting position of the frame beyond the matrix and located in the direction of adjustment of the frame and connected to the cylinder of the vertically adjustable piston rod. If before and afterward there is talk about a vertically adjustable piston rod it is possible, if necessary, to associate additional equivalent piston rods with it, for which the same applies in the same extent as what has been said with regard to the one piston rod.

Preferably one sensor each is arranged on both sides of the matrix, whereby both sensors are jointly connected to the cylinder of the piston rod. Since the sensors are all of the same kind, below only one of the sensors is discussed.

The above described punching installation admits several possibilities of application. Of these the one is most advantageous and constitutes an additional subject matter of the invention, where the cylinder of the piston rod is impinged and the frame is lifted, until the sensor strikes against the bottom side of the material to be punched, and the movement of the piston rod upwardly is terminated, whereupon the die is lowered. Further adjustment of the frame toward the top of the matrix results in the matrix contacting the material to be punched, whereupon the die receives the punching impulse.

As a result, the movement of the heavy weight is restricted to a path which, considering the relation of the short scale beam section to the distance of the weight from the beam pivoting bearing, corresponds with the distance of the sensor as to altitude in its starting position from the top side of the matrix. If, for example, the distance of the matrix from the bottom side of the material to be punched has been selected as being 8 mm., and if the altitude distance of the sensor from the top side of the matrix is 2 mm., the distance of the sensor from the bottom side of the blank, namely, 6 mm., is immaterial for the movement of the weight on the longer beam section. Only the movement of the frame over a path of 2 mm. is decisive. Only with this path of 2 mm. the weight at the scale beam also is adjusted over a corresponding path, that is at a transmission ratio of the short and long scale beam of 1:10, the weight only travels 20 mm.

Thus, the invention is based on the idea of dividing the necessary distance between the matrix and the bottom side of the material to be punched, into one section, above which the frame is lifted by means of the piston rod, whereby the scale beam and thus the weight are lifted accordingly, and into a second substantially smaller section over which the frame is moved with the stopped piston rod. This last-named small path of the weight prevents a high acceleration of the mass of the weight with the resultant disadvantages that would flow therefrom.

The possibility of guiding the matrix without the sensor from the bottom as far as the material to be punched, prior to lowering the die, is prohibitive, because the material to be punched is placed loosely on the feed roll table and would be carried along by the upwardly moving matrix prior to the interruption of the upward movement of the piston rod. It must be taken into consideration in this connection that with such an upward movement of the mass, the matrix with the frame and the weight at the scale beam as control impulse for disconnecting the piston rod only are opposed by the inherent weight of the material to be punched, which is low in relation to said mass.

The drawing represents an embodiment of the installation according to the invention.

Figure 1:
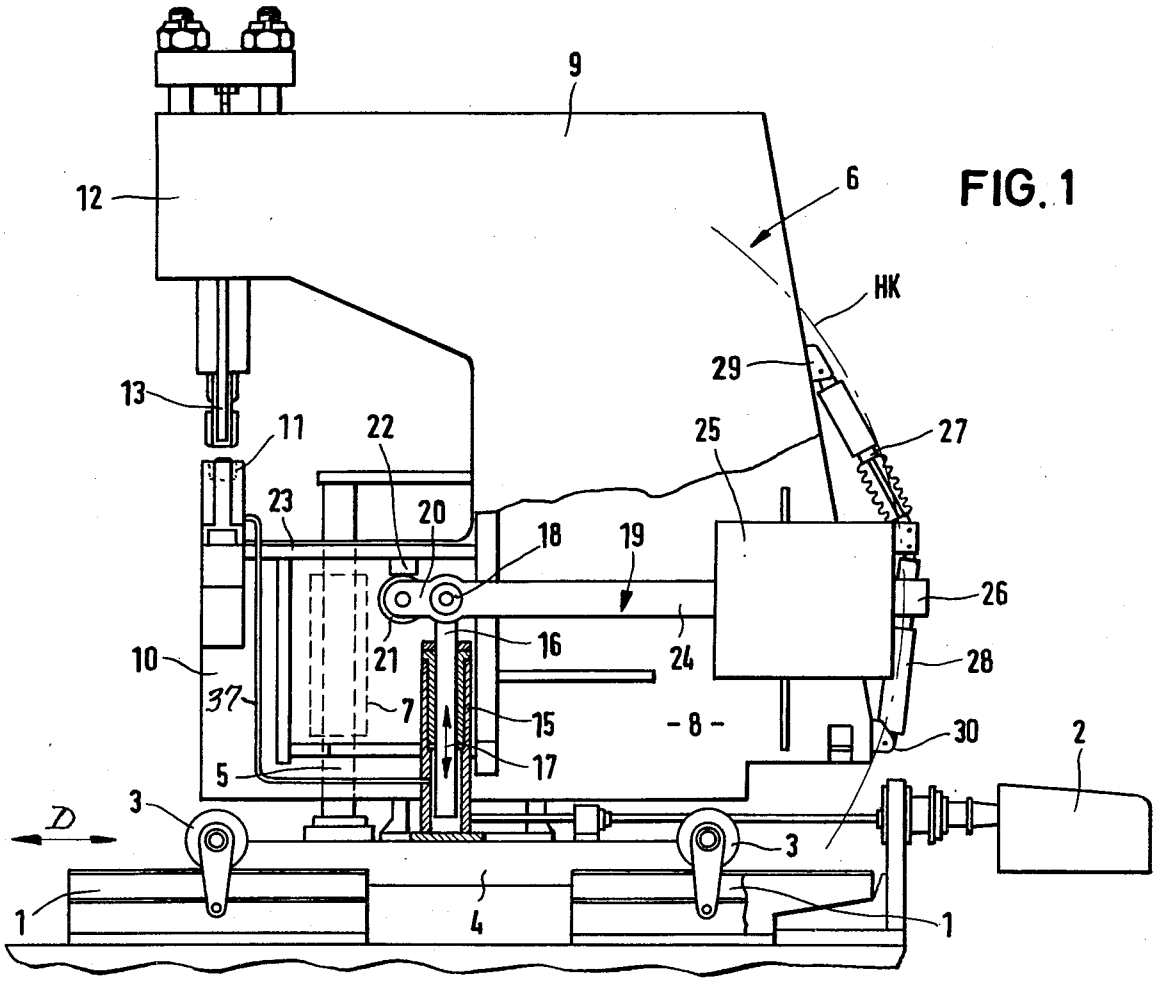
FIG. 1 shows a lateral view.

The bottom plate 4 bearing the vertical column 5 can be moved on the foundation parts 1 by means of the motor 2, on rollers or wheels 3 in the direction of the double arrow D. The distance of the columns in transverse direction of the bottom plate 4 (transversely to the direction of movement) approximately corresponds with the thickness of the frame 6 which is guided with the aid of the bushings 7 of the two sideplates 8, 9 of the frame 6 at the columns. The columns 5 and the bushings 7 in their arrangement at the outer sides of the frame plates 8, 9 assure a precise vertical guiding of the frame 6 with regard to the horizontally displaceable bottom plate 4. The frame also may be provided, if necessary, with an additional resilient suspension at the columns.

The frame 6 is designed as a U-shaped yoke, whose leg 10 bears the matrix 11, while at the leg 12 the punching die 13 is positioned with its guide and propulsion means. If the vertically movable punching die impacts upon the material to be punched St, as will be explained below, the frame 6 will be lifted by a small distance far enough until the matrix 11 finally comes to positively contact the material to be punched, whereupon the punching impulse is applied and with further depressing of the punching die 13 the punching hole is applied.

The bottom plate 4 bears between the plates 8, 9 of the frame 6 a cylinder-piston assembly 15, whose piston rod 16 can be raised and lowered in the direction of the arrow 17. The upper end of the piston rod bears a pivoting shaft 18 for a scale beam 19 which extends like the parts 15, 16, 18, into the interstice between both plates 8, 9 of the frame 6. The shorter section 20 of the scale beam 19 is provided with a roller 21 which engages from the bottom against an extension 22 of a transverse strut 23 of the frame 6, said strut connecting both plates 8, 9.

The longer section 24 of the scale beam 19 which is pivotable about the shaft 18 protrudes with its end out of the frame 6 and bears in the interstice between both panels 8, 9 a weight 25 which is displaceable in the longitudinal direction of the scale beam 19. The weight 25 preferably is of such a design and arrangement that it is guided laterally by both panels 8, 9 without thereby adversely affecting the pivotal movement of the scale beam 19 with the weight 25.

Equalization and attenuation springs 27, 28 attach at the free end of the scale beam 19 approximately in the direction of the semicircle HK drawn about the bearing 18, one end of said springs being connected to the scale beam 19, while the second end is fastened to the frame 6 at 29 and 30. The spring tension of both springs 27, 28 is adjustable.

Figure 3:
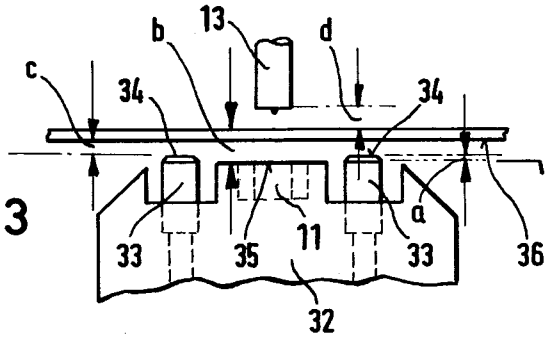
FIGS. 3 to 5 show various positions of the die, the matrix and two sensors placed laterally thereof, before and during the punching operation.

Resiliently mounted adjustable sensors 33, whose upper frontal side 34, as can be seen from FIG. 3, protrudes over the top side 35 of the matrix 11 in the starting position of the sensors by the distance $a$ in an upward direction, are arranged bilaterally of matrix 11 vertically in the matrix holder 32 of the frame 6 and are thus adjustable in the direction of movement of the frame 6. The distance of matrix 11 from the bottom side 36 of the material to be punched St shall thereby amount to $b$, so that the frontal side of the sensors shows a distance $C = b - a$ from the material to be punched St. The distance $d$ from the die 13 to the top side of the material to be punched may be the usual one.

The sensors 33 are so connected via corresponding control and amplifier elements not shown, and via conduit 37 with the cylinder-piston assembly 15 that, as the sensors 33 respond, the upward movement of the piston rod which was started by the operator of the installation is terminated and the piston rod 16 is maintained in its attained position.

Figure 4:
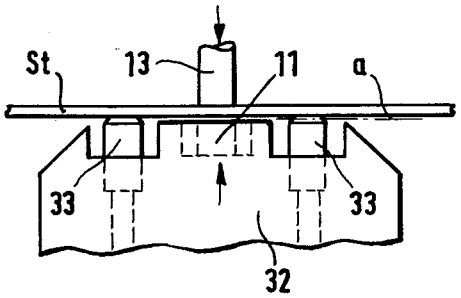
Figure 5:
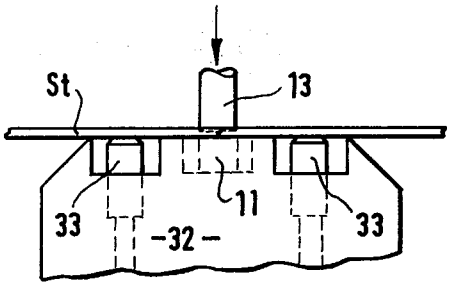
Figure 2:
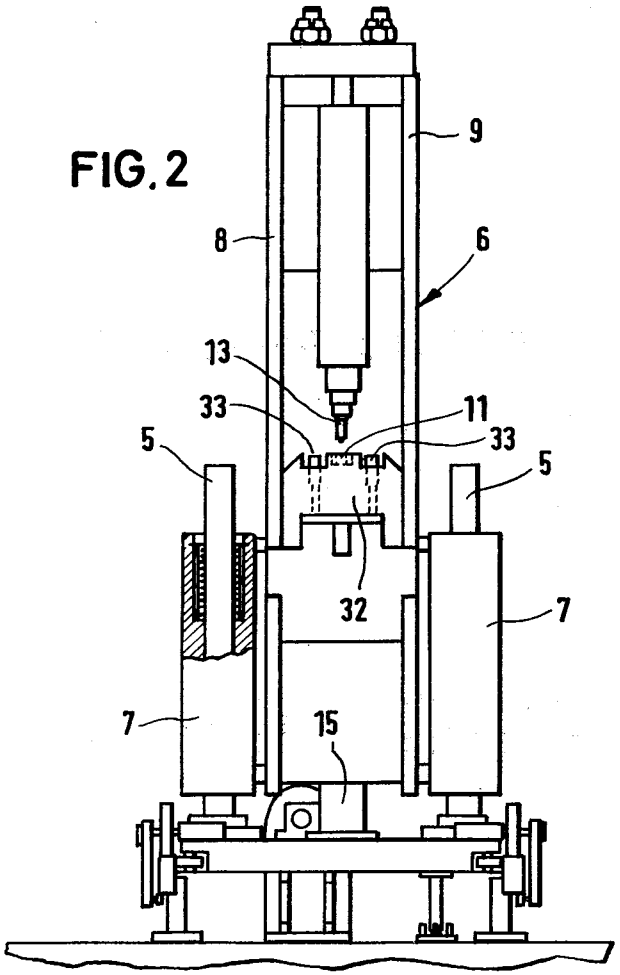
FIG. 2 shows a view of the installation from the front.

The preferred manner of operation with the punching installation according to the invention shapes up as follows: The frame 6 occupies a position where the sensors 33 and the die 13 occupy the position represented in FIG. 3. If at first the cylinder-piston assembly 15 is actuated, the piston rod 16 lifts the scale beam 19 and with it, without changing its relative position, the frame 6 and the weight 25. Thereby the sensors 33 overcome the distance $C$ until it contacts the bottom side 36 of the punched material St. Upon impact with it (FIG. 4) the sensors are activated and disconnect the cylinder-piston assembly, whose piston rod 16 is maintained in its attained position. Now the matrix 11 only shows the small distance $a$ to the bottom side of the material to be punched. If now the die 13 is moved downward in the leg 12, it hits upon the material to be punched. In order to move during the further course of its downward movement, the frame 6 moves via path $a$ until the matrix 11 contacts the bottom side of the material to be punched St (FIG. 5), after which the punching impulse is imparted upon the die 13.

Because, as pointed out, the frame 6 only travels a small path until the matrix 11 contacts the material to be punched, and the weight 25 is also displaced over a relatively smaller path during this movement of the frame, the relatively small path movement for the weight 25 is not exposed to any high acceleration. If it is assumed that the distances be $a = 2$ mm., $b = 8$ mm., hence $C = 6$ mm., and $d = 8$ mm., and the relation of the distances of the axis of roller 21 from the pivotal axis 18 to the distance of the weight be 1:10 to this axis, then the following results: Without the sensors according to the invention the frame would have to travel the path over the distance $b = 8$ mm. and the weight 25 would have to travel a path of 80 mm. With the installation according to the invention, on the other hand, the frame 6 travels at a relative pivotal movement of the weight 25 only over a path of distance $a = 2$ mm. and the weight thus travels only 20 mm., that is, only 25% of the first-named path of the weight, causing a correspondingly low acceleration of the mass of weight 25.

The connection of the sensors 33 to the cylinder-piston assembly 15 may preferably be electrical, but it also may be of any other appropriate kind.

It is intended to cover by the appended claims all modifications and variations that fall within the scope thereof.

What is claimed is:

1. A stamping device comprising a vertically guided frame assembly including a matrix and an aligned opposed punching die positioned to punch holes in a member disposed therebetween, means supporting said frame assembly in a balanced position to permit ready movement of the member to be punched relative to said matrix and die, said means including a balancing weight disposed on one end of a lever and a frame contacting and supported on the other end of said lever, said lever being pivotally connected intermediate its ends to motor means for controlling reciprocal movement thereof, sensor means responsive to the position of said member for controlling the operation of said motor means whereby the frame will be moved linearly until said sensor means engage said member at which time linear movement of the frame is halted and the die is actuated to punch a hole in said member.

2. A stamping device as set forth in claim 1 in which the sensor means are located in said matrix and extend slightly above the surface thereof.

3. A stamping device as set forth in claim 2 including reset springs for returning the frame to a balanced position and in which the motor means is mounted to vertically move the frame member and the die and matrix are vertically aligned.

4. A stamping device as set forth in claim 3 in which the sensor means includes a pair of sensors located on opposite sides of the matrix.

* * * * *